United States Patent [19]

Booz

[11] Patent Number: 4,469,282

[45] Date of Patent: Sep. 4, 1984

[54] METAL FLAKE PRODUCTION

[75] Inventor: A. David Booz, New Kensington, Pa.

[73] Assignee: Aluminum Company of America, Pittsburgh, Pa.

[21] Appl. No.: 492,549

[22] Filed: May 11, 1983

Related U.S. Application Data

[63] Continuation-in-part of Ser. No. 863,217, Dec. 22, 1977, abandoned, which is a continuation-in-part of Ser. No. 730,181, Oct. 6, 1976, Pat. No. 4,065,060.

[51] Int. Cl.[3] ..... B02C 23/18

[52] U.S. Cl. ..... 241/16; 241/24; 241/30

[58] Field of Search ..... 241/15, 16, 20, 24, 241/30, 38, 61, 62, 79, 79.2, 179, 171, 176, 184, 863, 217, 33, 34

[56] References Cited

U.S. PATENT DOCUMENTS 3,181,800 5/1965 Noren et al. ..... 241/36 X 3,369,761 2/1968 Hand ..... 241/33

*Primary Examiner*—Howard N. Goldberg

*Assistant Examiner*—Timothy V. Eley

*Attorney, Agent, or Firm*—Brian D. Smith

[57] ABSTRACT

A method of forming metal flake from metal particles comprises charging metal particles, liquid and milling material to a mill and operating the mill to form the metal flake. A portion of the metal flake, liquid and milling material is removed from the mill at a rate substantially commensurate with the charging thereto and milling material is separated from the liquid and metal flake.

14 Claims, 3 Drawing Figures

FIG. 1.
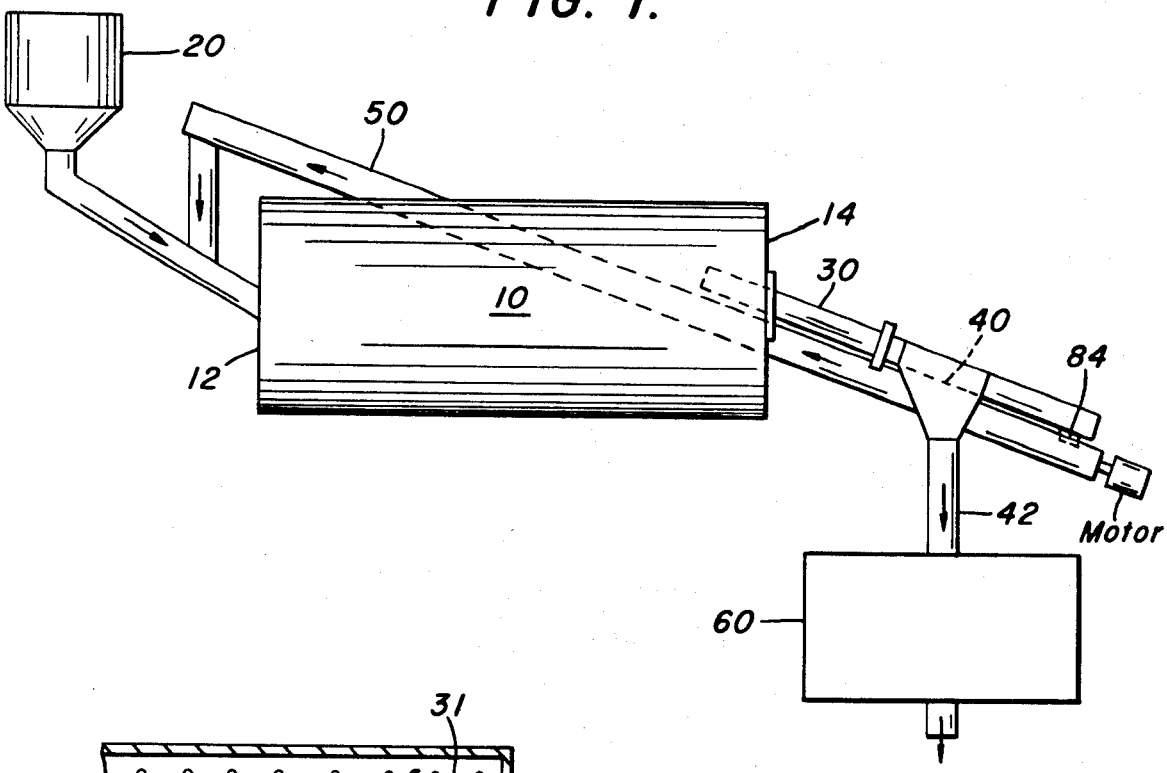
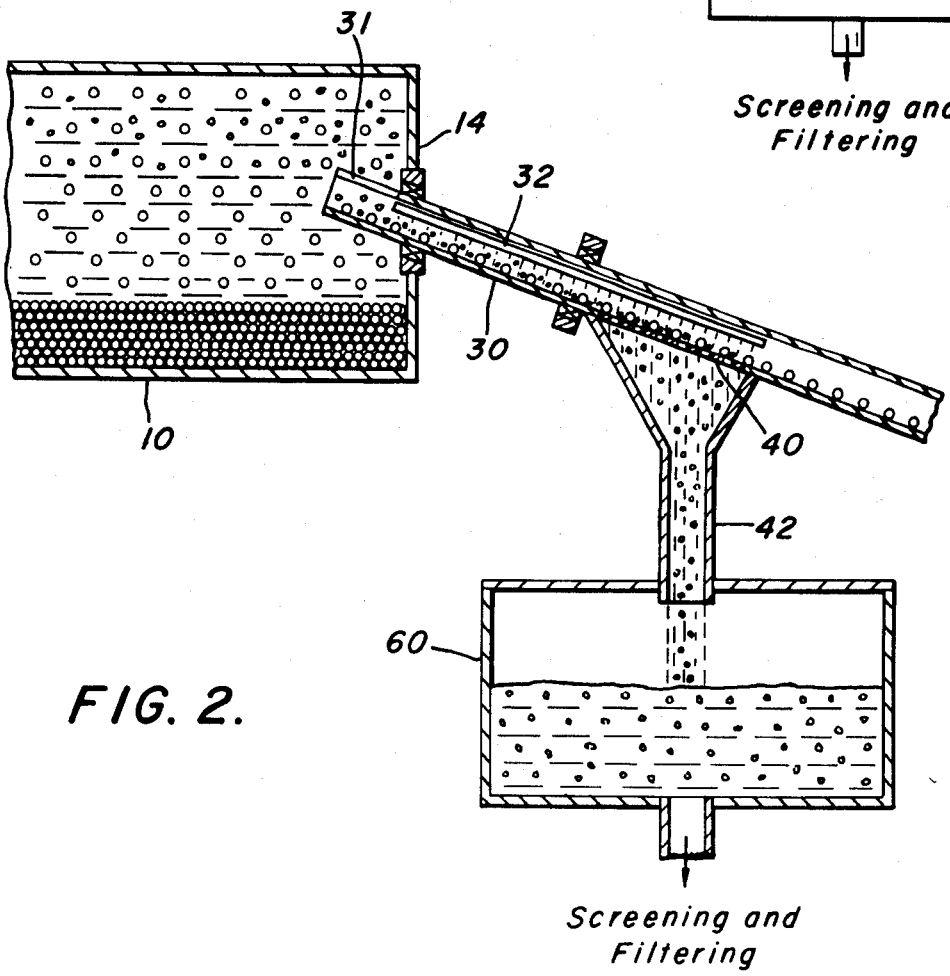
FIG. 2.

METAL FLAKE PRODUCTION

CROSS REFERENCE TO RELATED APPLICATION

This application is a continuation-in-part of application Ser. No. 863,217, filed Dec. 22, 1977, now abandoned which is a continuation in part of Ser. No. 730,181, Filed Oct. 6, 1976, now U.S. Pat. No. 4,065,060.

INTRODUCTION

This invention relates to production of metal flake and more particularly it relates to a method for the production of metal flake from metal particles.

In the prior art, metal flake has been produced in a ball mill or grinding mill or the like wherein the balls or grinding media are retained within the mill and the raw materials are added and the finished product removed. The raw materials may be added periodically or may be added substantially continuously. In the former, the finished product, i.e. the ground material, is generally removed batchwise. In the case where the raw materials are added continuously, the finished product may be removed continuously by operations which include grate discharge, trunnion overflow and air sweep or the like as shown in Ball, Tube and Rod Mills, H. E. Rose and R. M. E. Sullivan, 1958, pp. 22–23. However, these continuous systems for grinding have serious deficiencies. For example, it has been found over the years that most efficient grinding or milling to produce metal flake, particularly in wet grinding, requires that the metal particles or powder should comprise 45 to 55 wt.% of the raw materials charged to the mill. However, having a charge containing this amount of metal normally results in having great difficulty in pumping or otherwise removing the ground material from the mill. Thus, for pumping or gravity flow purposes, normally the charge is diluted to contain only about 25 to 35 wt.% of the metal particles. However, this dilution effect retards the grinding or metal flake producing operation. Thus it can be seen that in using grate discharge or trunnion overflow methods a compromise is reached between efficient milling and transporting materials through the mill.

The present invention solves the problem encountered in using prior art type mills by providing a method which permits metal flake production at optimum metal concentrations.

SUMMARY OF THE INVENTION

An object of this invention is the production of metal flake.

Another object of this invention is the production of metal flake in a wet mill grinding operation.

Yet another object of this invention is the continuous production of metal flake in a ball mill.

These and other objects will become apparent from the drawing, description and claims appended hereto .

In accordance with these objectives, a method of forming metal flake comprises charging metal particles, liquid and milling material to a ball mill, forming the metal flake therein and removing it and milling material from the mill at a rate commensurate with the charging rates. The flake is then separated from the milling material which is recirculated to the mill using a conveyor for purposes of the charging step. An apparatus for producing metal flake in accordance with the process of the invention comprises a ball mill adapted to rotate about its longitudinal axis and means for supplying raw materials such as metal particles, milling material, lubricant and solvent to the mill. In addition, the apparatus comprises a discharge scoop suitable for removing metal flake and milling material at a controlled rate. Upon rotation of the mill, metal flake and milling material enter the scoop, are removed and the milling material is separated from the metal flake and returned or circulated to the mill. In a preferred embodiment, the milling material is returned for purposes of charging to the mill by use of a screw type conveyor and trough, the conveyor having a flight at least a portion of which is located in the trough, the flight adapted to provide a space between the flight and the trough of not greater than about two-thirds the diameter of the milling material.

BRIEF DESCRIPTION OF THE DRAWINGS

FIG. 1 is a schematic of a grinding mill system in accordance with the invention.

FIG. 2 is a cross-sectional view of the grinding mill discharge scoop.

DETAILED DESCRIPTION OF THE PREFERRED EMBODIMENTS

Figure 3:
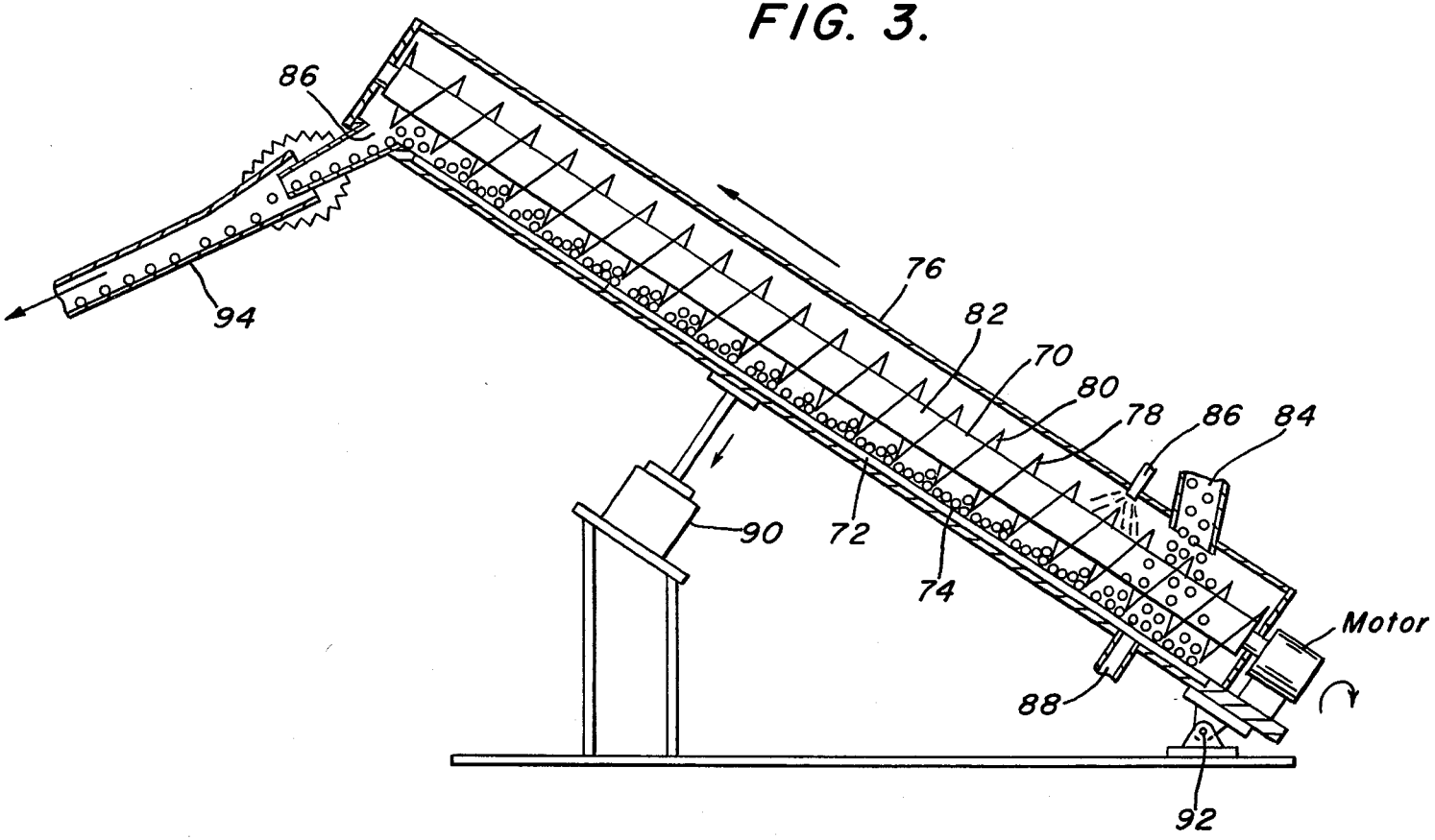
FIG. 3 is a cross-sectional view of the screw type conveyor and trough used to return the milling material for purposes of charging to the mill.

In accordance with the invention, metal flake is formed by charging metal particles, liquid, e.g. milling lubricant and solvent, and milling material to a ball mill. After milling, metal flake formed, milling material and liquid are removed at a rate substantially commensurate with the charging rates. The flake is then separated from the milling material. In a preferred embodiment, the milling material, for example metal balls, are recirculated and introduced to the mill at a controlled rate. Apparatus suitable for the process includes a ball mill having a discharge scoop adapted to remove the metal flake and the milling material. The apparatus can also include means for separating the metal flake from the milling material and also means for recirculating the milling material to the mill.

Metal particles which can be worked or formed into metal flake include metal powder, chips, filings, borings and the like, the preferred particle form being metal powder. Metals which may be provided in this form and which can be formed into flake include aluminum, nickel, copper, zinc, iron, stainless steel and alloys such as bronze and brass.

Milling lubricant useful in the present invention includes longer chain fatty acids such as stearic acid, lauric acid, oleic acid, behenic acid with stearic acid being preferred for reasons of economics and efficiency during milling. Other lubricants, including tallow, may be used depending largely on the type of flake desired.

When making aluminum flake from aluminum powder, a source of oxygen such as air can be added to the mill to control the reactivity of the aluminum flake surface. That is, air added to the mill reacts with the aluminum flake surface to form aluminum oxide, thereby lowering flake reactivity. Conversely, if it is desired to form a highly reactive aluminum flake surface, oxygen or air can be excluded from the mill by the use of an inert gas such as nitrogen, argon, helium and the like.

In the present invention it is preferred to add a solvent such as mineral spirits, particularly when metal flake, e.g. aluminum flake, is being formed. The mineral spirits solvent helps control dust and substantially eliminates problems arising therefrom. Also, the solvent aids in controlling uniformity of temperature throughout the mill by improving heat transfer. In addition, in the production of metal flake for use in paints, the use of solvents provides a pre-wetted flake which is more easily dispersed in the paint.

With respect to the milling material, it is preferred to use generally spherical metal balls since they act to provide highly efficient grinding. Further, it is preferred that the metal in such balls is steel. The balls useful in the present invention typically range in size from 3/16" to ⅜" in diameter although in certain cases smaller, e.g. ⅛ inch, or larger balls, e.g. 1 inch, may be used depending to some extent on the starting material.

In the process of the invention, the metal particles, milling lubricant and solvent can be added separately to the grinding mill. However, it is preferred that the metal particles and milling lubricant be mixed prior to being added to the mill. When the metal is aluminum, these materials are added to provide a mix in the mill comprising 30 to 70 wt.% metal particles with a preferred range being 35 to 65 wt.%, 0.4 to 7 wt.% lubricant, the remainder solvent. A typical mix for aluminum comprises 45 to 55 wt.% metal, 1.0 to 4.5 wt.% lubricant, the remainder solvent. This consistency is important in order that the mix has the desired viscosity when passing through the mill to provide maximum efficiency in grinding as mentioned hereinabove. Thus, it will be noted that while in the preferred embodiment, the present invention operates with a mix of 45 to 55 wt.% for aluminum, for the most efficient metal flake production, it is within the purview of the present invention to operate at lower or higher metal concentrations depending on the metal used. For example, if the metal to be formed into flake is selected from the group consisting of nickel, copper, zinc, brass, bronze, iron and stainless steel, then the mix can comprise up to 85 wt.% of these metals with the remainder being lubricant and solvent. A suitable mix for this group would be in the range of 50 to 83 wt.%.

Another important aspect of the present invention is the weight ratio of milling material, i.e. metal balls or spheres to metal particles present in the ball mill. In the present invention, this weight ratio can range from 18:1 to 60:1 with a preferred range being 20:1 to 40:1 when milling metal particles such as aluminum. When the metal particles are selected from the group of metals consisting of nickel, copper, zinc, brass, bronze, iron and stainless steel, this ratio can range from 5:1 to 20:1. Thus, while it is important to control the metal particle content in the mill as noted earlier, it is also important to add to the controlled metal particle concentration a controlled amount of milling material to obtain the maximum benefits of this invention.

Having the raw materials such as metal powder, milling lubricant, solvents and milling material controlled essentially as above permits the production of fine, medium or coarse flake by varying the residence time in the ball mill. In a continuous ball mill, the residence time is determined by the time required for the materials to move from the entrance to the exit of the mill. Because the mix in the present ball mill is quite viscous when compared to conventional continuous grinding operations, the movement of the materials through the mill approximates plug flow. That is, a given mass of ingredients required to produce flake moves from the entrance to the exit of the mill with substantially no backmixing or short-circuiting and the attendant problem of over or under grinding, i.e. producing excessive fines or excessive amounts of coarse particles. Thus, in the present mill, there is substantially controlled movement from the entrance to the exit of the mill. It will be appreciated that the time to move from entrance to exit, i.e. residency time, can vary from a few hours to a few days depending to some extent on the metal particle size and the amount of grinding required.

Movement of materials through the mill is controlled by flow of materials to or from the mill. That is, the residence time of the materials in the mill can be increased by decreasing the rate of flow or addition of feed to the mill and by decreasing the rate of removal of materials from the mill. Conversely, the residence time in the mill can be decreased by increasing the rate of flow or addition of feed to the mill and increasing the rate of removal of materials from the mill. Thus, it will be seen that particle size of the flake can be easily controlled by adjusting these rates. That is, the size of the flake can be decreased by increasing the residence time.

On reaching the exit of the mill, metal flake, milling lubricant, solvent and milling material are removed at a controlled rate. Upon removal, the milling material is separated from the other materials. This may be accomplished by diluting the mix to about 5 to 20 wt.% metal for aluminum flake and the like, and permitting flake, lubricant and solvent to pass through a screen which retains the milling material. For heavier metals such as nickel, copper, zinc, brass, bronze, iron and stainless steel, the mix may be diluted to contain about 20 to 65 wt.% metal. After separation, the milling material may be returned or recirculated to the entrance of the mill for further use. The metal flake may be passed to a holding tank for purposes of subsequent screening and filtering.

With reference to FIG. 1, for the process of the present invention, there is shown a schematic of an apparatus comprising a ball mill 10 generally cylindrical or tubular in shape, a feed hopper 20, and a discharge scoop 30. A separator 40 is provided to separate metal flake from the balls as best seen in FIG. 2. Conveyor means 50 (described in detail hereinafter) serves to return the balls for recirculation through mill 10. Conduit 42 conveys metal flake and solvent to holding tank 60 from which the flake can be dispersed for screening and filtering. Thus, it can be seen that after the initial start-up of mill 10, raw material, e.g. metal powder, milling lubricant and solvent, along with steel balls, can be introduced at entrance end 12 of the mill and metal flake and steel balls removed at exit end 14 of mill 10 more or less continuously. That is, metal flake and milling material can be removed at a rate substantially commensurate with the charging rate.

Discharge scoop 30 is an important aspect of the system since it permits controlled removal of metal flake, lubricant, solvent and milling balls. Discharge scoop 30 may be constructed from a circular pipe or the like by providing a longitudinal slot 31 therein. The slotted pipe, preferably inclined from the horizontal at a slope in the range of 15° to 35°, should be mounted so as to be rotatable about its axis, permitting the size of the slot as seen by falling flake and balls during rotation of the mill to be adjusted. That is, the slotted opening can be adjusted by rotation of scoop 30 about its axis to increase or decrease the amount of flake and balls being caught or falling into it in the mill, thereby regulating the flow of materials from the mill.

It should be noted that when the mill of the present invention is operated or rotated at a certain speed, the materials will be lifted by the wall of the mill. At this certain speed, the balls and metal particles or metal flake will then tumble or drop onto balls and flake on the opposite side of the mill, producing metal flake in this way as well known in the art. It is during this process of tumbling or dropping that the balls, metal flake and liquid are preferably caught in scoop 30 and removed at a controlled rate.

As will be seen from FIG. 2, located within discharge scoop 30 is a spray means 32 to wash the steel balls free of metal flake. In this washing operation, solvent is added in an amount sufficient to make the flake easily pumpable or flowable. Preferably, when aluminum flake is being produced sufficient solvent is added during the spraying operation to lower the aluminum content to 5 to 25 wt.%. It should be noted that the spray aids the flow of flake and metal balls down the inclined slope of discharge scoop 30 to screen 40 where the flake is separated from the balls. The flake and solvent flow through conduit 42 to holding tank 60. The steel balls, after separation, can be continuously returned by a suitable conveyor means, such as a screw type conveyor, as shown in FIG. 3, for example.

With reference to FIG. 3, there is shown a conveyor 70 and trough 72 which act to return milling material 74 for feeding to the mill. In the illustration provided in FIG. 3, the conveyor is provided with a jacket or housing 76. Also, the conveyor illustrated in FIG. 3 is the screw type having a flight 78 which on rotation returns or directs the milling material for reuse in the mill. In FIG. 3 the flight is shown as a helical fin 80 which is mounted on a central shaft 82. Upon rotation of the shaft, the fin pushes the milling material along the trough. In FIG. 3, the milling material which enters the lower end of housing 76 through opening 84 is moved by rotation action to the opposite end and discharged through opening 86. In the present system, it is important that the distance or space between the outer edge of the flight and the trough be closely controlled for purposes of operating the conveyor with freedom from jamming. Thus, in the region where the flight is in contact with the milling material, the space between the outer edge of the flight and the trough should not be greater than $\frac{2}{3}$ of the diameter of the milling material. In a preferred embodiment, the space should be controlled so as to be less than $\frac{1}{2}$ the diameter of the milling material. Thus, for example, when balls having a diameter in the range of 3/16 to $\frac{3}{8}$ inch, typically the distance between the outer edge of the flight and the wall of the trough should be controlled so as to be less than 0.15 inch and preferably less than 0.09 inch with a typical or highly suitable distance being in the range of 0.005 to 0.01 inch.

As noted earlier, the trough is provided with housing or cover 76 to prevent loss of liquid, e.g. solvent such as mineral spirits, by vaporization. In addition, cover 76 prevents loss of spray in further washing or rinsing of the milling material to remove any residual flake not removed during the separation step. It will be noted that solvent spray may be introduced through a suitable nozzle referred to as 86 in FIG. 3. Solvent spray introduced to the conveyor may be removed through opening 88.

As previously mentioned, metal flake size is to a great extent dependent upon the flow rates at which the materials, i.e. milling media and feed materials (liquid and metal particles) pass through the mill. To obtain metal flake having a predetermined size, it is important to predetermine the flow rates that produce the desired particle size and to maintain those predetermined flow rates during process operation. In the embodiment illustrated in FIG. 3, the milling media being recirculated by conveyor 70 can be charged to the mill at a predetermined and substantially constant flow rate by adjusting or regulating the rate at which materials, i.e. metal flake, liquid and milling media, are removed from the mill. If, for example, an increase in the predetermined recirculating milling media flow rate is detected, the rate at which materials are removed from the mill can be decreased. Such will necessarily decrease the flow rate of the milling media being recirculated to the mill, and this decrease will continue until the flow rate drops below its predetermined rate, at which time the drop can be sensed and corrected by increasing the rate at which material is removed from the mill. The embodiment illustrated in FIG. 3 employs a weighing means 90 to sense or detect changes in the predetermined, recirculating milling media flow rate. It can be seen that the conveyor and trough which are pivotally anchored at 92 are supported by weighing means 90. Thus, after being calibrated, it will be appreciated that weighing means 90 can sense or detect any changes in the milling media flow rate and thereby provide input to a removal means, such as scoop 30 in FIGS. 1 and 2, which can respond accordingly to either increase or decrease the rate at which material is removed from the mill. Other suitable means for sensing or detecting changes in the recirculating flow rate include laser sensing means and electronic sensing means, such as those based upon magnetic, capacitive or inductive field distortion. Other sensing means apparent to those skilled in the relevant art are also considered to be within the purview of the present invention. It can also be seen in FIG. 3 that a telescoping sleeve 94 is provided to carry the milling material away from opening 86. A screen may be provided on sleeve 94 for purposes of removing undersized grinding material.

The apparatus of the present invention may be operated on the basis of an open circuit in which case large particles removed from the mill with the metal flake are screened out of the system. In addition, the apparatus may be operated on a closed circuit basis, in which case the large particles removed from the mill are screened out and continuously fed back to the mill at its entrance end.

The gas referred to earlier is preferably provided so as to have parallel flow with the materials passing through the mill. That is, gas is preferably added at the entrance end of the mill and removed at the exit end. The gas can be added and removed by means well known to those skilled in the art.

The metal flake produced according to this invention can be employed in a vast number of paint, coating and ink formulations where their value as a pigment have long been established. More recently, as is known in the art, such products have been widely employed in various explosive and blasting formulations where they have great value as a booster fuel and serve to provide requisite sensitivity for initiation.

The present invention is advantageous since it improves both milling efficiency and overall productivity significantly. Another advantage resides in the fact that flake size can be adjusted by changing the feed and removal rates. Also, because of the controlled flow through the mill, flake size can be controlled, preventing the flake from prematurely reaching a limiting size. Also, because of the controlled flow through the mill, backmixing, which is undesirable since it results in excessive fines being generated, is kept to a minimum. The present system is also advantageous since it is not impeded with the high solvent content in order to be pumpable. That is, as noted earlier, metal particle content can be maximized for optimum milling.

The following examples are still further illustrative of the invention:

EXAMPLE 1

Aluminum flake was produced in accordance with the invention in a ball mill of about 3 feet in diameter and 8.5 feet long. For purposes of start-up the mill was charged initially with 5,421 pounds of steel balls about 5/16 inches in diameter. The mill was operated such that steel balls would be removed and recirculated at about 11.3 lbs./min. Alcoa grade 120 atomized aluminum powder containing 5 wt.% stearic acid was added at a feed rate of 29 lbs./hr. Mineral spirits was added to the mill at 4.5 gallons/hr. and air was passed through the mill at 5 SCFM. The mill was rotated at 44 rpm. After steady state conditions were obtained, an 8 hour residence time was used for milling purposes, steady state being obtained after about 3 residence periods. The feed rates established an aluminum metal particle concentration of about 50 wt.% and a ball to aluminum particle weight ratio of 23.4 to 1. Aluminum flake produced, balls and solvent were removed from the milling action and sprayed with mineral spirits substantially as shown in FIG. 2 to wash the balls free of the metal flake and to aid in separation of the balls from the flake. That is, the spray washed the flake from the balls and through a 10 mesh screen (U.S. series) which screen prevented the balls from passing. After separation, the balls were recirculated to the entrance end and fed into the mill. After passing through a 60 mesh screen (U.S. series) to ensure against the presence of large particles, aluminum flake produced had a median particle size of 13.6 microns, as measured by a Coulter counter.

EXAMPLE 2

Operating conditions were as in Example 1 except the feed rate of aluminum powder was 18.1 lbs./hr. and the ball to aluminum metal particle ratio was 27.4 to 1. The aluminum flake obtained had a median particle size of 11.3 microns.

EXAMPLE 3

Operating conditions were as in Example 2 except the feed rate of aluminum powder was 33.9 lbs./hr. and the ball to feed weight ratio was 20:1. The aluminum flake obtained had a median particle size of 16.3 microns.

EXAMPLE 4

Aluminum flake was produced in the ball mill of Example 1. In this instance, the mill was charged with 7,270 pounds of steel balls of about 5/16 diameter. The recirculation rate of the steel balls was 24.3 lbs./min. and feed rate of Alcoa grade 108 atomized powder containing 3 wt.% stearic acid was 56.7 lbs./hr. Mineral spirits feed rate was 7.1 gallons/hr. and air feed rate was 5 SCFM at a pressure of 5 psig. The average residence time was 5.0 hours. In this example, large particles were continuously removed and returned to the mill for further milling. Aluminum flake obtained during this process had a median particle size of 15.6 microns.

It will be seen from these examples that aluminum flake can be produced on a continuous basis, operating at an aluminum particle concentration of about 50 wt.%. However, the concentration can be changed as required. Also, the above examples show that the particle size can be controlled to the desired size by modification of the feed rates.

While the invention has been described in terms of preferred embodiments, the claims appended hereto are intended to encompass other embodiments which fall within the spirit of the invention.

Having thus described the invention and certain embodiments thereof, what is claimed is:

1. A method of forming aluminum flake having a predetermined size from aluminum particles in a ball mill wherein backmixing is minimized, said method comprising:

(a) charging the ball mill with milling media to be recirculated at a predetermined constant flow rate and with feed materials at a predetermined flow rate to provide a mix therein comprising approximately 30 to 70 wt.% aluminum particles, the remainder liquid;

(b) operating the mill to form said aluminum flake;

(c) removing the aluminum flake, liquid and milling media from the mill at a rate commensurate with said charging thereto;

(d) separating the milling media from the liquid and aluminum flake by addition of solvent to provide a mix having a aluminum flake content in the range of 5 to 20 wt.%;

(e) recirculating the milling media to the mill; and (f) maintaining the predetermined flow rates at which said feed materials and the recirculating milling media are charged to the mill to produce aluminum flake having a predetermined size and to minimize backmixing in the mill, said predetermined milling media flow rate being maintained by varying the rate at which said milling media is removed from the mill so as to correct any deviations in the recirculating milling media flow rate from the predetermined recirculating milling media flow rate.

2. A method according to claim 1 wherein the step of removing includes projecting a discharge scoop into the ball mill such that on rotation of said mill a portion of the metal flake, liquid and milling media can be removed by being directed into said scoop.

3. A method of forming metal flake having a predetermined size from metal particles in a ball mill wherein backmixing is minimized, said method comprising:

(a) charging the ball mill with milling media to be recirculated at a predetermined flow rate and with feed materials at a predetermined constant flow rate to provide a mix therein comprising approximately 30 to 85 wt.% metal particles, the remainder liquid;

(b) operating the mill to form said metal flake;

(c) removing the metal flake, liquid and milling media from the mill at a rate commensurate with said charging thereto;

(d) separating the milling media from the liquid and metal flake by washing the milling media substantially free of said metal flake;

(e) recirculating the milling media to the mill; and (f) maintaining the predetermined flow rates at which said feed materials and the recirculating milling media are charged to the mill to produce metal flake having a predetermined size and to minimize backmixing in the mill, said predetermined recirculating milling media flow rate being maintained by varying the rate at which said milling media is removed from the mill so as to correct any deviations in the recirculating milling media flow rate from the predetermined recirculating milling media flow rate.

4. The method according to claim 3 wherein the metal particles comprise aluminum particles.

5. The method according to claim 3 wherein the liquid comprises mineral spirits.

6. The method according to claim 4 wherein the weight ratio of milling media to metal particles is in the range of 18:1 to 60:1.

7. The method according to claim 3 wherein the metal particles comprise a metal selected from the group consisting of nickel, copper, zinc, brass, bronze, iron and stainless steel, the mix contains 50 to 83 wt.% metal particles.

8. The method according to claim 7 wherein the weight ratio of milling media to metal particles is in the range of 5:1 to 20:1.

9. The method according to claim 7 wherein in the separating step liquid is added to provide a mix having a metal flake content in the range of 20 to 65 wt.%.

10. The method according to claim 3 wherein the space between the flight and the trough is adapted to be less than one-half the diameter of the milling material.

11. A method according to claim 3 wherein the step of removing includes projecting a discharge scoop into the ball mill such that on rotation of said mill a portion of the metal flake, liquid and milling media can be removed by being directed into said scoop.

12. The method according to claim 3 wherein the changes in the milling media flow rate are detected by sensing changes in the weight of the milling media being recirculated to the mill.

13. The method according to claim 12 wherein the milling media is recirculated employing a conveyor and trough, the conveyor having a flight at least a portion thereof located in the trough for purposes of said recirculating, the conveyor adapted to provide a space between the flight and trough of not greater than two-thirds the diameter of the milling media.

14. The method according to claim 13 wherein a screw type conveyor is employed.

* * * * *